US010240328B1

(12) United States Patent
Estelhomme

(10) Patent No.: US 10,240,328 B1
(45) Date of Patent: Mar. 26, 2019

(54) DUAL PROVISION SHOWER HEAD

(71) Applicant: Tracey Estelhomme, Lauderhill, FL (US)

(72) Inventor: Tracey Estelhomme, Lauderhill, FL (US)

(73) Assignee: Tracey Estelhomme, Lauderhill, FL (US)

( * ) Notice: Subject to any disclaimer, the term of this patent is extended or adjusted under 35 U.S.C. 154(b) by 1 day.

(21) Appl. No.: 15/702,756

(22) Filed: Sep. 12, 2017

(51) Int. Cl.
*B05B 1/00* (2006.01)
*E03C 1/046* (2006.01)
*B05B 1/18* (2006.01)

(52) U.S. Cl.
CPC ..... *E03C 1/046* (2013.01); *B05B 1/18* (2013.01)

(58) Field of Classification Search
CPC ..... B05B 7/04; B05B 7/0408; B05B 7/1436; B05B 11/0078; B05B 11/0081; E03C 1/046
USPC ..... 239/302, 303, 304, 305, 307, 310
See application file for complete search history.

(56) References Cited

U.S. PATENT DOCUMENTS 1,117,634 A * 11/1914 Bowes ..... A45D 40/24 401/19
1,217,597 A * 2/1917 Hecht et al. ..... A46B 11/066 401/289
1,342,994 A * 6/1920 Fitzgerald ..... A47K 7/028 401/28
1,478,392 A * 12/1923 Kearney ..... A46B 11/001 132/313
1,521,111 A * 12/1924 La Bree ..... A47K 7/028 401/291
1,668,802 A * 5/1928 Cantrell ..... E03C 1/046 239/142
1,679,561 A * 8/1928 Cantrell ..... E03C 1/046 137/559
1,751,524 A * 3/1930 Moss ..... E03C 1/046 239/315
2,019,705 A * 11/1935 Hubert ..... A47L 17/00 15/29
2,603,805 A * 7/1952 Maestas ..... A46B 11/066 239/315
2,659,627 A * 11/1953 McConnell ..... E03C 1/046 239/316
2,739,328 A * 3/1956 Bernier ..... A46B 11/001 401/288
2,986,340 A * 5/1961 Webb ..... E03C 1/046 239/310
3,070,316 A * 12/1962 Miville ..... E03C 1/046 137/268
3,194,444 A * 7/1965 Hubert ..... A01C 23/042 137/205.5

(Continued)

*Primary Examiner* — Viet Le

(57) ABSTRACT

A shower head that includes a spigot having threads for the assembly of a shower hose having an entrance point with a hollow structure for the passage of a water stream, a shower head handle having a spigot connected to the inferior position of the handle, an internally embedded soap dispenser having a chamber that is positioned in the internal structure of the shower head, along with a head connection leading from the superior position of the shower head handle which is opposite of the end of the shower head handle where the spigot is connected, and also includes a pattern plate accompanied with one or more pattern hole(s).

7 Claims, 7 Drawing Sheets

(56) References Cited

U.S. PATENT DOCUMENTS 3,231,200 A * 1/1966 Heald ..... E03C 1/046 137/889
3,581,998 A * 6/1971 Roche ..... E03C 1/046 239/310
3,589,819 A * 6/1971 Bryant ..... A47L 13/23 401/289
3,610,535 A * 10/1971 Bradshaw ..... B01F 15/0201 239/305
3,628,732 A * 12/1971 Vicari ..... E03C 1/046 239/310
3,763,888 A * 10/1973 Duecker ..... A47L 17/00 137/889
3,764,074 A * 10/1973 James ..... B05B 7/12 239/318
3,891,149 A * 6/1975 Rendemonti ..... B05B 12/02 239/304
3,944,140 A * 3/1976 Caton ..... B05B 3/04 15/24
4,171,169 A * 10/1979 Williams ..... A46B 11/066 137/607
4,193,520 A * 3/1980 Duffield ..... E03C 1/046 222/133
4,218,013 A * 8/1980 Davison ..... B05B 7/12 137/889
4,236,840 A * 12/1980 Kennedy ..... A01K 13/002 401/270
4,322,036 A * 3/1982 Bly ..... E03C 1/046 239/311
4,366,840 A * 1/1983 McKane, Jr. ..... E03C 1/046 137/599.12
4,609,149 A * 9/1986 Jessen ..... B05B 12/002 239/310
4,623,095 A * 11/1986 Pronk ..... E03C 1/046 239/311
4,933,080 A * 6/1990 Rundzaitis ..... B01D 35/043 210/232
4,998,836 A * 3/1991 Scripnick ..... B05B 7/30 137/878
D326,896 S * 6/1992 McNeely ..... D23/213
5,174,503 A * 12/1992 Gasaway ..... B05B 7/30 222/132
5,192,427 A * 3/1993 Eger ..... A47K 3/281 210/133
5,333,789 A * 8/1994 Garneys ..... B05B 7/2445 239/318
5,370,274 A * 12/1994 Ohmi ..... B05B 7/28 222/135
5,469,889 A * 11/1995 Tang ..... F16K 11/087 137/625.41
5,544,810 A * 8/1996 Horvath, Jr. ..... B05B 7/2443 239/10
5,579,656 A * 12/1996 Shin ..... D06F 39/02 137/268
5,626,291 A * 5/1997 Flinn ..... B01F 5/0413 239/310
5,713,519 A * 2/1998 Sandison ..... B05B 7/0846 239/307
5,716,005 A * 2/1998 McMahan ..... A46B 11/066 239/305
5,769,318 A * 6/1998 Greubel ..... B05B 7/2462 239/10
5,915,622 A * 6/1999 Foote ..... E03C 1/046 239/10
5,957,379 A * 9/1999 McMorrow ..... B05B 7/2445 239/10
6,006,374 A * 12/1999 Winnett ..... E03C 1/046 239/312
6,012,649 A * 1/2000 Riddell ..... A01C 23/042 141/330
6,036,110 A * 3/2000 Kanatzar ..... E03C 1/046 239/317
6,116,798 A * 9/2000 Chen ..... A46B 11/066 401/139
6,257,786 B1 * 7/2001 Thomas ..... A46B 11/066 222/145.5
6,340,257 B1 * 1/2002 Chia-Yi ..... A47L 13/22 222/145.1
6,345,773 B1 * 2/2002 Shanklin ..... B05B 7/2424 239/304
6,402,053 B1 * 6/2002 Chih ..... B05B 7/2445 239/305
6,557,782 B1 * 5/2003 Urra ..... B05B 7/2462 239/302
6,571,805 B2 * 6/2003 Hoenisch ..... B08B 3/026 134/103.2
6,705,545 B1 * 3/2004 Sroka ..... B05B 7/1404 239/112
6,827,293 B2 * 12/2004 Seeman ..... B01F 5/0496 239/310
6,923,384 B2 * 8/2005 Cernik ..... E03C 1/0465 239/318
7,093,775 B1 * 8/2006 Bingham ..... B05B 7/2443 139/323
7,118,049 B2 * 10/2006 Dodd ..... B05B 7/1209 239/318
7,188,786 B2 * 3/2007 Dodd ..... B05B 7/1209 222/630
7,255,293 B2 * 8/2007 Dodd ..... B05B 7/1209 137/588
7,320,438 B1 * 1/2008 Latin ..... E03C 1/046 239/305
7,331,488 B2 * 2/2008 Naslund ..... F16K 31/52416 134/100.1
7,341,207 B2 * 3/2008 Hubmann ..... B05B 7/12 239/307
7,905,429 B2 * 3/2011 Somerfield ..... E03C 1/046 137/101.11
8,024,822 B2 * 9/2011 Macan ..... E03C 1/066 4/615
D663,014 S * 7/2012 Taylor ..... D23/228
8,393,350 B2 * 3/2013 Chiriac ..... E03C 1/046 137/268
8,702,018 B1 * 4/2014 Rivera ..... E03C 1/0408 239/310
8,857,737 B2 * 10/2014 Chen ..... B05B 3/06 239/302
9,022,073 B2 * 5/2015 Strauli ..... E03C 1/046 137/888
9,062,777 B2 * 6/2015 Shanklin ..... B05B 7/1209
2004/0016826 A1 * 1/2004 Rice ..... A47K 5/08 239/310
2008/0169359 A1 * 7/2008 Carrubba ..... B05B 7/2443 239/310
2009/0101733 A1 * 4/2009 Popov ..... B05B 1/1636 239/310
2009/0113616 A1 * 5/2009 Daly, Sr. ..... A46B 11/0058 4/606
2009/0314851 A1 * 12/2009 Bonacci ..... E03C 1/0409 239/10
2012/0091231 A1 * 4/2012 Ajagbe ..... B05B 1/18 239/418
2012/0100296 A1 * 4/2012 Larson ..... B05B 7/2408 427/372.2
2012/0175429 A1 * 7/2012 Zupsic ..... B05B 7/2467 239/8
2014/0239094 A1 * 8/2014 Munro ..... B65D 83/682 239/304
2015/0129675 A1 * 5/2015 Serenelli ..... A01C 23/042 239/10
2015/0292186 A1 * 10/2015 Kawamoto ..... E03C 1/046 239/315

* cited by examiner

DUAL PROVISION SHOWER HEAD

CROSS-REFERENCE TO RELATED APPLICATIONS

N/A

BACKGROUND OF THE INVENTION

1. Field of the Invention

The present invention relates to a shower head that delivers both water and soap through the shower stream.

2. Description of Related Art

On a mainstream level, shower heads are predominantly known for dispensing streaming water to the one that is showering for hygiene purposes to promote hygienic behavior patterns. With the aid of soaps (liquid and/or bar) and shampoos (liquid and/or bar), shower heads can play a major role, hygienically, for the one that is showering. The shower head serves as an effective instrument geared toward the promotion of good health. Overtime the functions, designs, and accessibilities of shower heads have evolved from the many innovations of the original invention. Although, the invention of the shower head has made its advances toward improving its quality in function, design, and accessibility, the sole purpose has remained consistent throughout many years of its existence. The sole purpose of the shower head has been to dispense water to the one that is showering for desired usage.

Even with the many advances made with shower heads there continues to be very little advances toward convenience. Not convenience as in preferences such as speed, flow, installment, etc., but convenience such as accessibility for those who have physical disabilities, the elderly, individuals with medical conditions, and any other factor that may cause restrictions while showering. Therefore, prohibiting one that is showering from being able to conveniently shower, according to the social norm. Though, the use of a shower head is convenient for some, for others (for example: the elderly or physically disabled) it may be a perpetual inconvenience and sense of frustration having to maneuver showering (using water, soap, and/or shampoo) with limited accessibility due to uncontrollable physical restrictions or inevitable medical conditions. Within the past century there have been numerous advancements made toward incorporating soap to be dispensed along with water in the shower stream with the aid of a soap dispenser that is externally attached to the shower head. Nonetheless, the mechanisms involved with those advances are not convenient for distributing companies in the field of shower heads to create or for most consumers to utilize.

Generally, manufacturing shower head companies are solely specialized and involved with the production of shower heads and may solely be familiar with the mechanisms involved with shower heads and not with soap dispensers. Therefore, previously invented soap dispensing shower heads have not been widely adopted by companies or vendors. Also, predominantly, previous soap dispensing shower head inventions were designed to be stationary and compatible with the external soap dispenser, which makes it inconvenience for individuals with physical and/or medical restrictions and other extenuating conditions prohibiting one from utilizing a shower head according to the social norm. Furthermore, individuals with restricted or even non-restricted conditions may prefer the convenience of a shower head that is more accessible, flexible, and helpful in pursuing effective hygiene patterns.

Therefore, what is needed to resolve these problems is a shower head that can deliver both water and soap from the shower stream to the one that is showering.

BRIEF SUMMARY OF THE INVENTION

In one embodiment of the invention a shower head is provided, comprising a spigot having threads for the assembly of a shower hose and having an entrance point and hollow structure for the passage of a water stream, a shower head handle having a spigot connected to the inferior position of the handle, an internally embedded soap dispenser having a chamber that is positioned in the internal structure of the shower head, a head connection leading from the superior position of the shower head handle, opposite of the end of the shower head handle where the spigot is connected, and a pattern plate having one or more pattern hole(s).

Also in one embodiment the shower head handle is divided into two or more sectors enabling the shower head handle to furthermore expose the internally embedded soap dispenser chamber. In one embodiment there is further a source of a seal located between the divided sectors, of the shower head handle, allowing the shower head handle to be tightly sealed when the sectors of the shower head handle are connected. Also in one embodiment there is further a source of a hinge built on or into the shower head handle, wherein the hinge enables the divided sectors of the shower head handle to open and close without completely detaching while being held together by the hinge. In one embodiment there is further a source of a latch integrated on or into the shower head handle, and a hinge built on or into the shower head handle.

Also in one embodiment the integrated latch of the shower head handle enables the disengagement and reconnection of the divided sectors of the shower head handle. Also in one embodiment the hinge of the shower head handle enables the divided sectors of the shower head handle to open and close without completely detaching while being held together by the hinge. In one embodiment there is further a source of a latch slot and one or more latch glide groove(s). Also in one embodiment the latch slot and the latch glide groove(s) direct and enable movement of the latch when the latch is ascending or descending along the shower head handle when the sectors of the shower head handle are in the process of being sealed or detached. Also in one embodiment the internally embedded soap dispenser chamber is built into or connected to the internal structure of the shower head handle of the shower head. In one embodiment there is a further source of one or more valve(s) wherein the water stream of the shower head may emerge and travel through the shower head and the internally embedded soap dispenser chamber. Also in one embodiment there is a further source of a container, a brim, and a base, where the dispensing products placed in the internally embedded soap dispenser chamber may be contained. Also in one embodiment the pattern hole(s) compatibly enable the delivery of the melded substances, that may be, created in the internally embedded soap dispenser chamber.

DETAILED DESCRIPTION OF THE INVENTION

The inventor provides a shower head in a preferred embodiment that imitates a handheld shower head that, in this example, utilizes the mechanism of a dual operation system of an embedded soap dispenser and water stream function of a shower head. The present invention is described in enabling detail in the following examples, which may represent more than one embodiment of the present invention.

Figure 1:
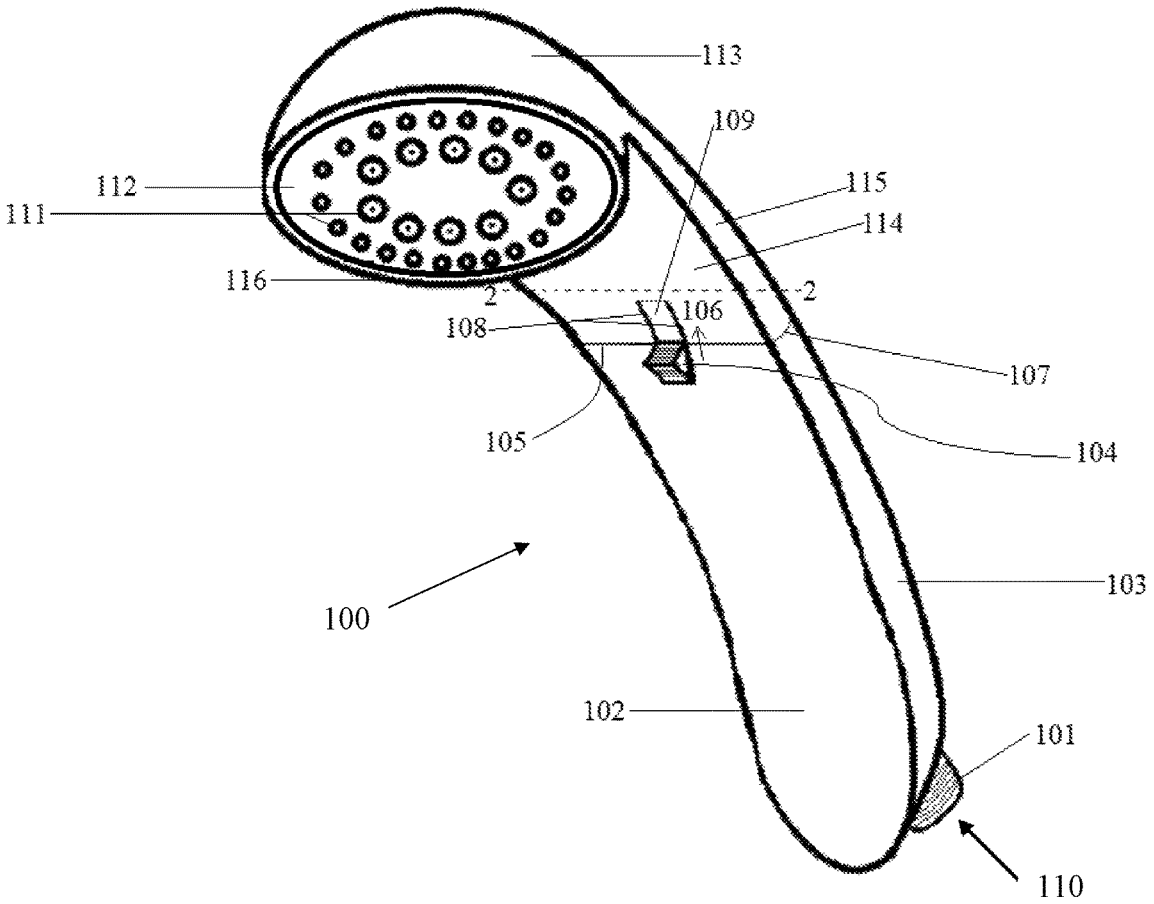
FIG. 1 is an elevation and perspective view of a closed shower head according to an embodiment of the present invention.

FIG. 1 is an elevation and perspective view of a closed shower head 100 according to an embodiment of the present invention. In this example, shower head 100 is adapted to imitate a handheld shower head. Though, the example should not be interpreted as a limitation of the present invention. Other depictions for shower head 100 are possible and may also be considered according to one or more embodiments of the present invention. In this example, the inventor chooses to use the depiction of a handheld shower head in a preferred embodiment because of the mechanisms involved with the present invention. In one embodiment of the invention a rain shower head, dual shower head, any other type of shower head or faucet may be imitated without deserting from the overall scope of the present invention.

In this example, the shower head 100 may include a spigot 101 accompanied with threads. The spigot 101 has a spigot entrance 110 to the hollow internal component of the spigot 101 for water passage. In this preferred embodiment, shower head 100 may include an obverse inferior handle section 102 and a posterior inferior handle section 103 for an inferior grip of the shower head 100. Directly above the obverse inferior handle section 102 and the posterior inferior handle section 103, in this example, the shower head 100 may include a sliding latch 104, a latch slot 109, a latch glide groove 108, a obverse seal 105, and a posterior seal 107. In this example of the shower head 100, the sliding latch 104 is directed upward 106 on the latch glide groove 108 and the latch slot 109, in a mechanism involved to cause the obverse seal 105 and posterior seal 107 to be released so that the handle of the shower head 100 could be opened at a given position of the handle.

In this embodiment, the shower head 100 may include an obverse superior handle section 114 and a posterior superior handle section 115 for a superior grip of the shower head 100. In this example, when the obverse seal 105 and the posterior seal 107 are released the obverse inferior handle section 102 is detached from the obverse superior handle section 114; the posterior inferior handle section 103 is detached from the posterior superior handle section 115. In this example, the shower head 100 may include a head connection 113 to an end of the posterior superior handle section 115. In this embodiment, the head connection 113 of the shower head 100 may include a shower head adjuster ring 116, a pattern plate 112, and one or more pattern hole(s) 111. In this example of the present invention the inventor chooses to more than one pattern hole. In this example, the shower head adjuster ring 116 may be interchangeable to where the preference in pattern holes 111 can be adjusted for desired usage. The pattern plate 112 in this example, lodges the pattern holes 111.

Figure 2:
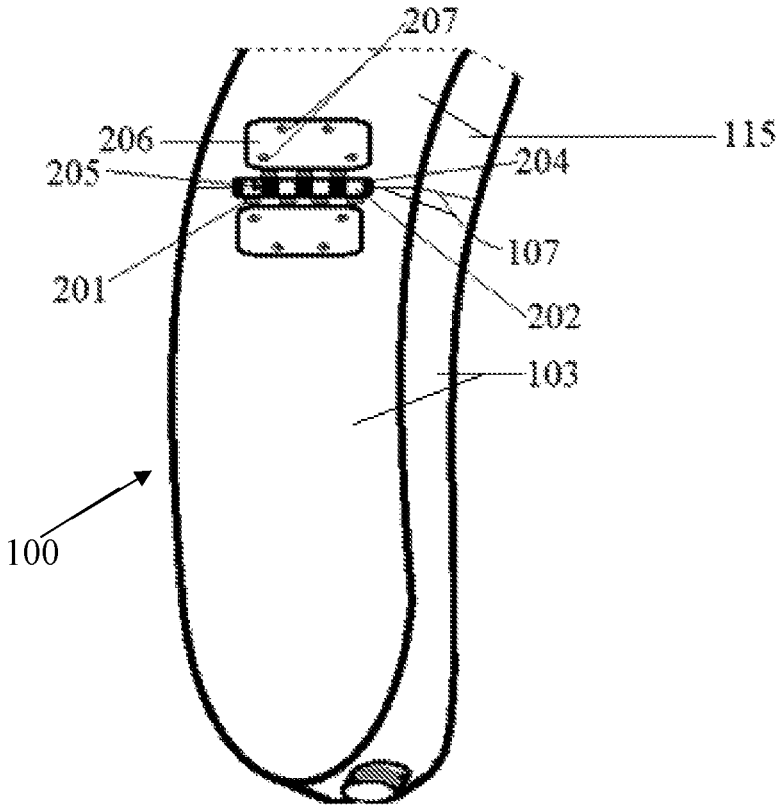
FIG. 2 is a rear fragmentary elevation view of FIG. 1 viewed along the section line 2-2 in FIG. 1 according to an embodiment of the present invention.

FIG. 2 is a rear fragmentary elevation view of FIG. 1 viewed along the section line 2-2 in FIG. 1 according to an embodiment of the present invention. In this example of the present invention, the shower head 100 may be modified to imitate a handheld shower head that may be accompanied by two hinge leaves 206 therein attached to a leaf connection piece 201, to hinge knuckles 202 and hinge bearings 205. This example of the embodiment of the present invention is not to be interpreted as a limitation of the present invention. Other depictions of attachable instruments may also be considered according to one or more embodiments of the present invention without deserting from the overall scope of the present invention. In this example, the inventor chooses to use the depiction of a hinge attached to the shower head 100, in a preferred embodiment because of the mechanism involved with the present invention.

In this preferred embodiment of the present invention, the posterior superior handle section 115 and posterior inferior handle section 103 may be each attached to a hinge leaf 206. In this embodiment, the hinge leaf 206 contains screws 207. The hinge leaf 206, of the embodiment of the present invention, has a leaf connection piece 201 that links the hinge leaf 206 to hinge knuckles 202 and hinge bearings 205. In this example, there is a pin tip 204, which is used to hold the hinge knuckles 202 and hinge bearings 205 in place.

In this example of the present invention, the mechanism facilitated for the shower head 100 viewed in FIG. 2 may be, upon the shower head 100 being released to be opened, the posterior seal 107 is released and slightly disjointed. Once the posterior seal 107 is slightly disjointed the hinge knuckles 202 and the hinge bearings 205 rotate in opposite directions of one another to completely open the disjointed shower head 100. In this embodiment, the leaf connection piece 201 that attach to the hinge knuckles 202 and hinge bearings 205 assure that the superior section 115 and inferior section 103 of the shower head 100 do not completely detach from one another, which would cause the shower head 100 to be divided into two ununified sections. In this embodiment, the screws 207 may be fastened to the hinge leaf 206 to secure the hinge leaf 206 on the posterior superior handle section 115 and the posterior inferior handle section 103 to prevent the hinge leaf 206 from eluding from the posterior superior handle section 115 and the posterior inferior handle section 103.

Figure 3:
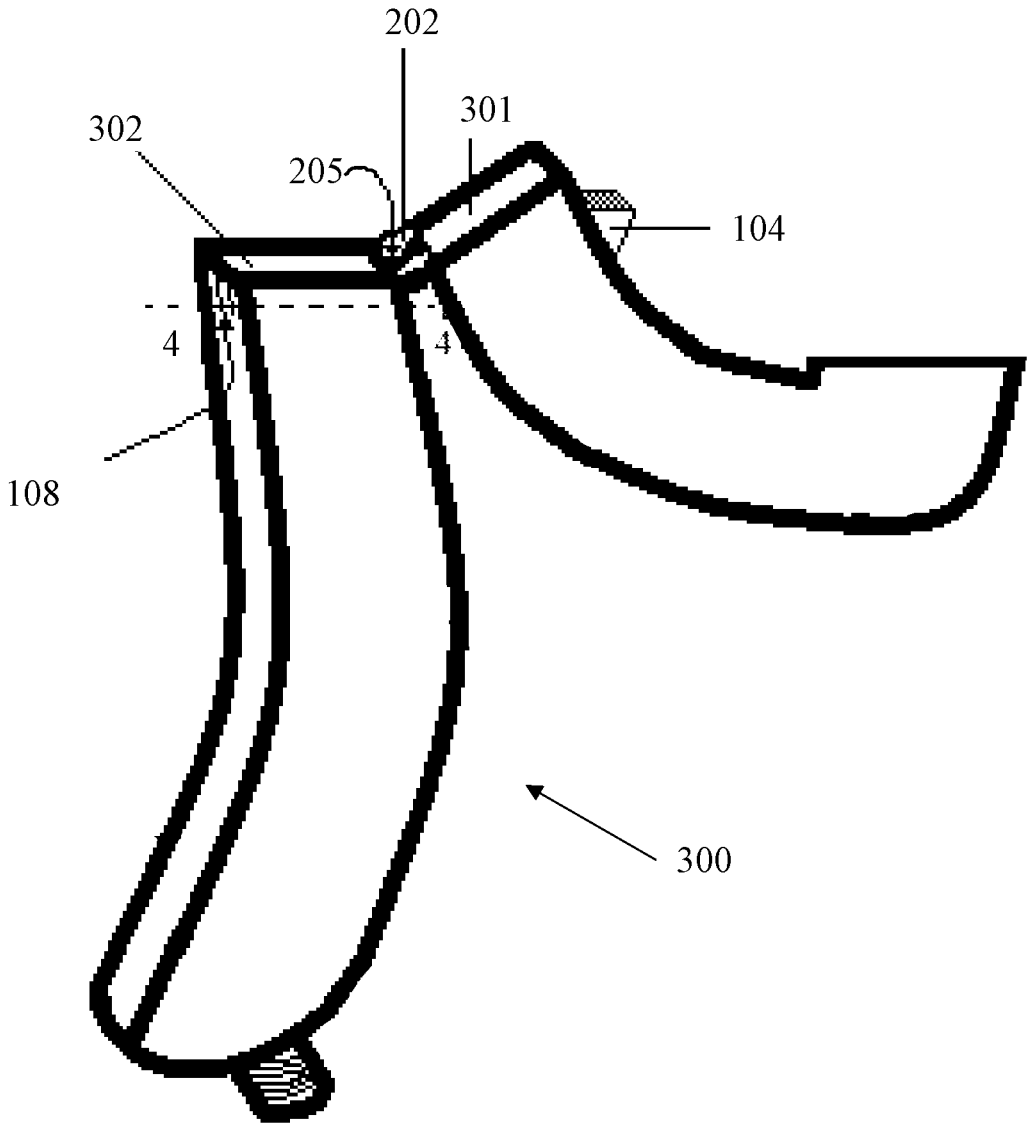
FIG. 3 is a side perspective view of a shower head open according to an embodiment of the present invention of FIG. 1.

FIG. 3 is a side perspective view of a shower head 300 open according to an embodiment of the present invention of FIG. 1. In one embodiment, there is a sliding latch 104 and latch glide grooves 108. In this example of the present invention, the mechanism facilitated for shower head 300 may be, when the sliding latch 104 is released from the sliding glide grooves 108, the hinge knuckles 202 and hinge bearings 205 rotate in opposite directions of one another, then the shower head's 300 internal structure will be made visible. In this example, the internal structure is divided into two sectors, a superior internal sector 301 and an inferior internal sector 302.

Figure 4:
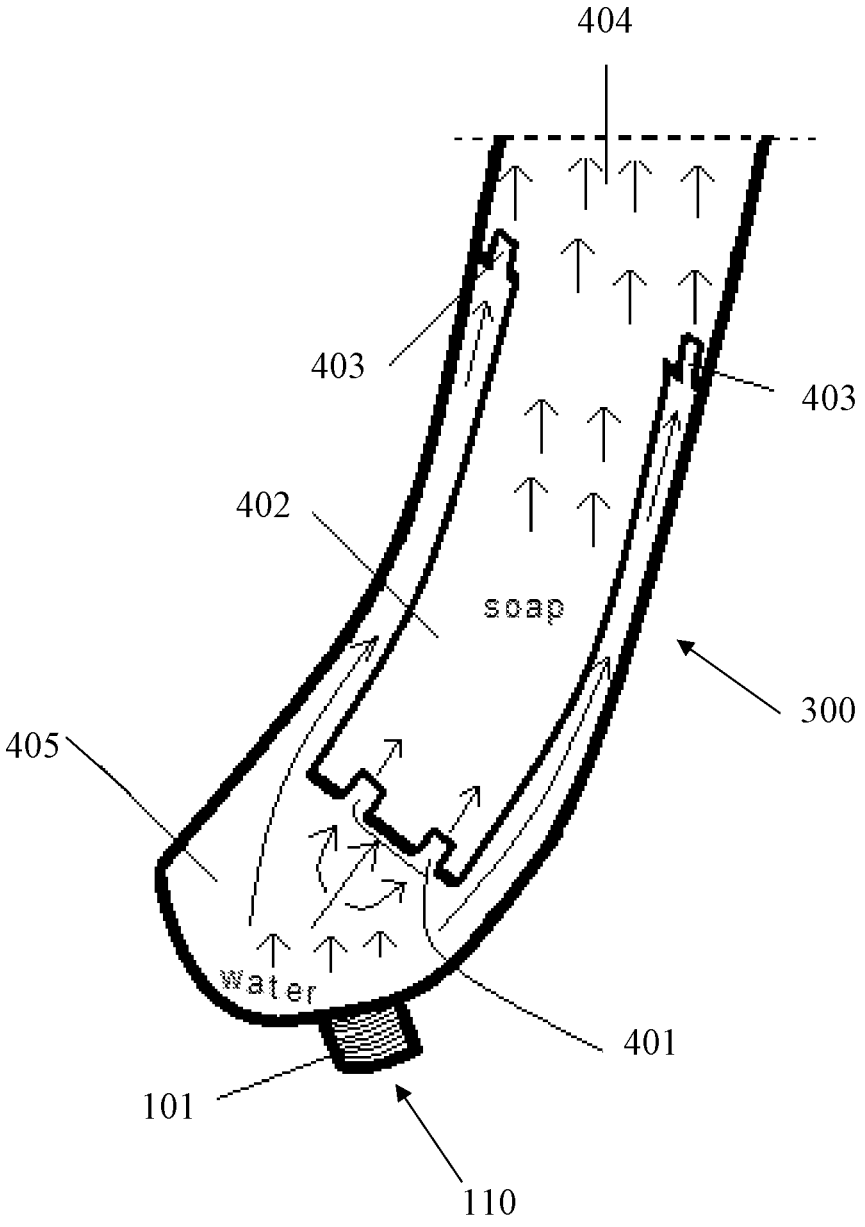
FIG. 4 is a cross-sectional view of FIG. 3 viewed along the section line 4-4 in FIG. 3, depicting the motion and direction of water and soap of an embodiment of the present invention.

FIG. 4 is a cross-sectional view of FIG. 3 viewed along the section line 4-4 in FIG. 3, depicting the motion and direction of water 405 and soap 402 of an embodiment of the present invention. In this preferred embodiment, shower head 300 may have a spigot entrance 110 to the spigot 101 where the water 405 passes through to the shower head 300. In one embodiment, shower head 300 may have one or more inferior internal valve(s) 401 and one or more superior internal valve(s) 403. In this example of the present invention the inventor chooses to depict more than one inferior internal valve 401 and superior internal valve 403. In the preferred embodiment of the present invention, the mechanism facilitated for the shower head 300 may be, once the water 405 passes through the spigot 101, the water 405 makes way to the inferior internal valves 401 and the superior internal valves 403. In this example, when the water 405 protrudes through the inferior internal valves 401, it merges with the deposited soap 402 in the shower head 300. The water 405 and soap 402 form a new liquid combination 404 which consist of the combination of water 405 and soap 402. The water 405 from the superior internal valves 403 further assist with passage of the stream of the new liquid combination 404 throughout the shower head 300.

Figure 5:
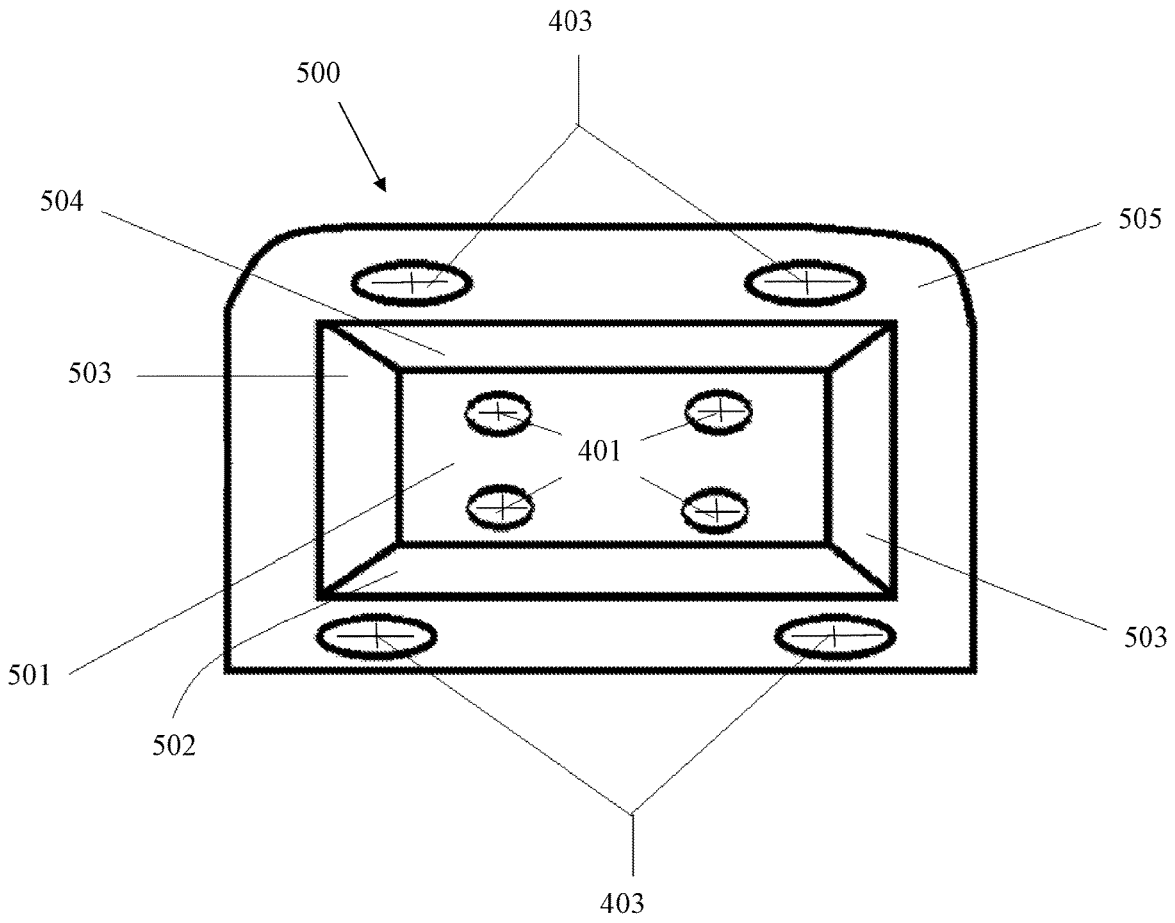
FIG. 5 is a top plan overhead view of FIG. 4, depicting an interior layout of an embodiment of the present invention.

FIG. 5 is a top plan overhead view of FIG. 4, depicting an interior layout of an embodiment of the present invention. In this example of the preferred embodiment, interior layout of the internally embedded soap dispenser 500 is visible. In this example, the internally embedded soap dispenser 500 may be where the soap deposit is contained to be combined with the water stream to be dispensed. In this embodiment, the internally embedded soap dispenser 500 may have a base 501 and one or more inferior internal valves 401 which may be located at the base 501. In this preferred embodiment of the present invention, the internally embedded soap dispenser 500 may also have a brim 505 and one or more superior internal valves 403 which may be located along the brim 505. In this example, the internally embedded soap dispenser 500 may have walls surrounding the base 501 and supporting the brim 505 of the container. In this preferred embodiment, these walls may be an obverse wall 502, later walls 503, and a posterior wall 504. In this example, these walls assist in containing the deposited soap dispensed in the internally embedded soap dispenser 500.

Figure 6:
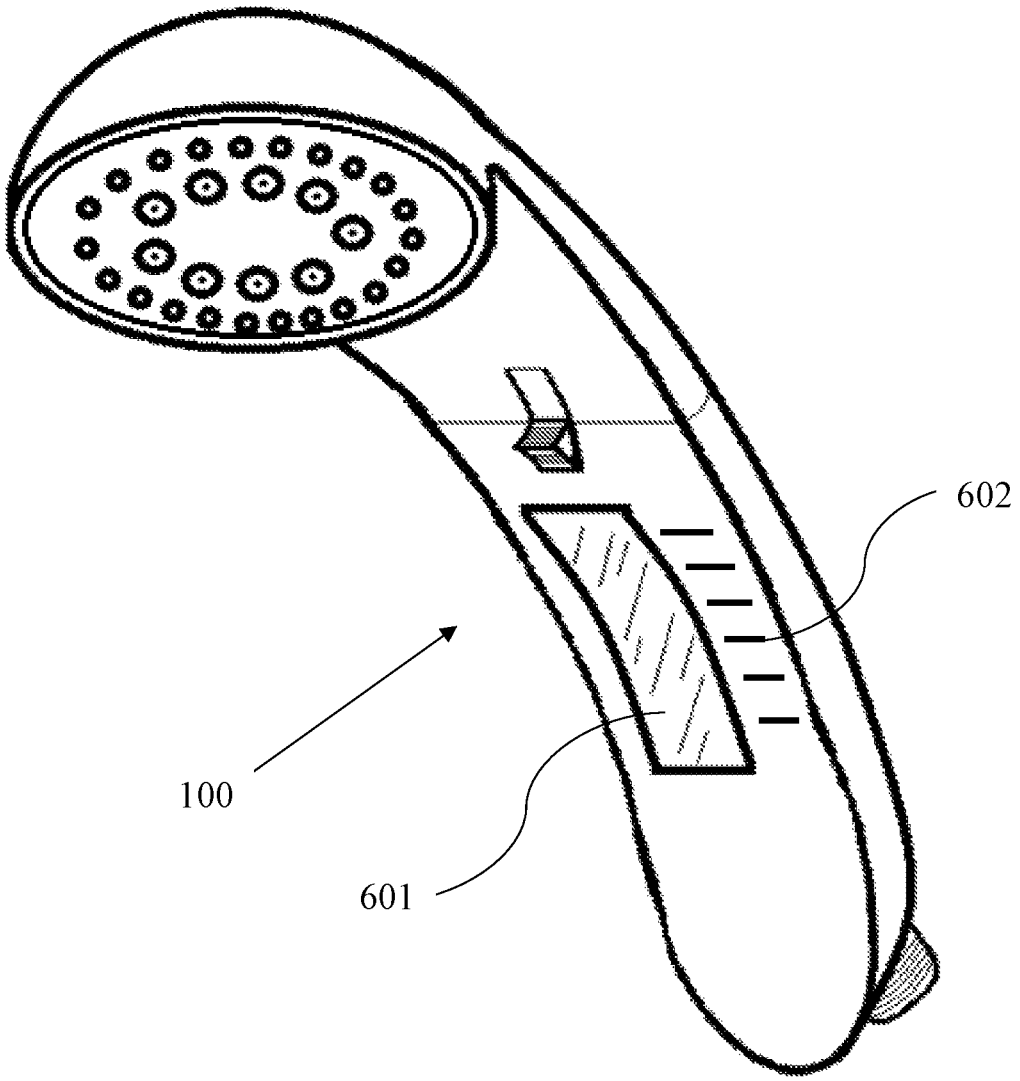
FIG. 6 is an elevation view of a shower head according to a further embodiment of the present invention.

FIG. 6 is an elevation view of a shower head 100 according to a further embodiment of the present invention. In this embodiment of the present invention, the shower head 100 further includes a feature that simulates a viewing window 601 and indicia 602. In other embodiments, other simulations may be employed in order to simulate a viewing window 601 and indicia 602. In this further embodiment, the indicia 602 is used to measure units of time and the viewing window 601 works as a correspondent to the indicia 602, so that the quantity of soap that is dispensed in the present invention may correlate to the desired quantity of time decided based upon the indicia 602 units. In other examples, other simulations may have the indicia 602 in consistent increments of five minutes, fifteen minutes, or thirty minutes. The further embodiment is not to be interpreted as a limitation of the further embodiment of the present invention.

Figure 7:
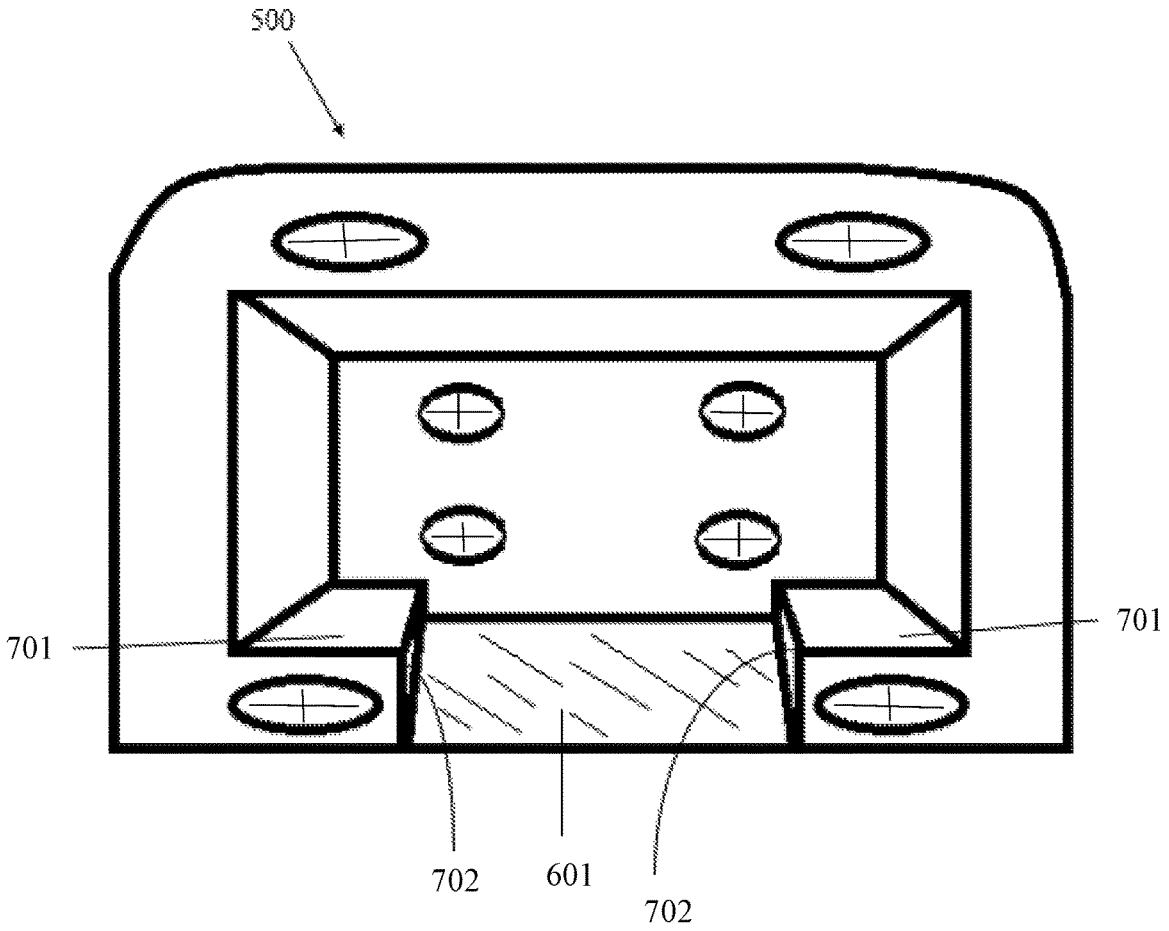
FIG. 7 is a top plan overhead view of an interior layout of an embodiment of the present invention according to a further embodiment of the present invention.

FIG. 7 is a top plan overhead view of an interior layout of an embodiment of the present invention according to a further embodiment of the present invention. In this example, the internally embedded soap dispenser 500 further includes a viewing window 601 and obverse walls 701 with obverse adjacent walls 702. Other replications may also be adopted in other embodiments of the present invention. This example is not to place any limitations on the further embodiment of the present invention.

The invention claimed is:

1. A shower head comprising:

a water inlet;

a shower nozzle with at least one discharge outlet;

an opening mechanism;

a first chamber and a second chamber, wherein the first chamber radially surrounds the second chamber, wherein the first chamber receives water from the water inlet;

the second chamber comprises an internally embedded soap dispenser being positioned within the second chamber, wherein the internally embedded soap dispenser is configured to receive a liquid or bar soap;

the second chamber further comprises at least one second inlet to receive water from the first chamber;

a mixing chamber, wherein fluid from the first chamber and the second chamber combine;

the second chamber is exposed into the mixing chamber;

the first chamber further comprises at least one first outlet which discharges into the mixing chamber;

the shower head is further divided into a first sector and a second sector, wherein the first sector comprises the mixing chamber and shower nozzle and the second sector comprises the first chamber, the second chamber, and the water inlet;

the opening mechanism comprises a hinge, the hinge is positioned between the first sector and the second sector, such that when the device is in an open position, the first and second sectors are displaced from one another such that the mixing chamber is displaced from the first and second chambers, wherein the second chamber is exposed such that a liquid or bar soap can be inserted into the internally embedded soap dispenser, and when the device is in a closed position, the first and second sectors are connected such that the mixing chamber is connected to the first and second chambers such that water and soap solution can be mixed and discharged through the at least one discharge outlet;

wherein during operation, the device is in closed position and water flows through the water inlet into the first chamber, water from the first chamber flows through the at least one second inlet such that water is mixed with the soap within the internally embedded soap dispenser to produce a soap solution, wherein water from the first chamber and the soap solution combine in the mixing chamber before being discharged from the at least one discharge outlet.

2. A shower head of claim 1 further comprising a seal located between the first sector and the second sector, of the shower head, allowing the shower head to be tightly sealed when the sectors of the shower head are connected.

3. A shower head of claim 1, further comprising an integrated latch, wherein the integrated latch of the shower head enables the disengagement and reconnection of the first sector and the second sector of the shower head.

4. A shower head of claim 1 further compromising a latch slot and one or more latch glide groove(s), wherein the slot and the groove(s) direct and enable movement of the latch when the latch is ascending or descending along the shower head when the sectors of the shower head are in the process of being sealed or detached.

5. A shower head of claim 1 wherein the internally embedded soap dispenser chamber is built into or connected to the internal structure of the shower head.

6. A shower head of claim 5 further comprising one or more valve(s) wherein the water stream of the shower head may emerge and travel through the shower head and the internally embedded soap dispenser chamber.

7. A shower head of claim 5 further comprising a container, a brim, and a base, wherein the dispensing products placed in the internally embedded soap dispenser chamber may be contained.

* * * * *